United States Patent [19]

Van Raemdonck

[11] Patent Number: 4,936,586

[45] Date of Patent: Jun. 26, 1990

[54] RACKET HANDLE

[75] Inventor: Joris Van Raemdonck, Bazel, Belgium

[73] Assignee: Donnay, S.A., Couvin, Belgium

[21] Appl. No.: 216,174

[22] Filed: Jul. 7, 1988

[30] Foreign Application Priority Data

Jul. 14, 1987 [BE] Belgium ..... 08700780

[51] Int. Cl.[5] ..... A63B 49/04; A63B 49/08

[52] U.S. Cl. ..... 273/73 J; 273/75; 273/81 A

[58] Field of Search ..... 273/73 J, 75, 81 R, 273/81 A, 170, 171

[56] References Cited

U.S. PATENT DOCUMENTS

| | | | |
|---|---|---|---|
| 1,696,462 | 12/1928 | Victor | 273/81 A |
| 2,772,090 | 11/1956 | Brandon | 273/81 A |
| 3,606,325 | 9/1971 | Lamkin et al. | 273/75 |
| 3,606,327 | 9/1971 | Gorman | 273/81 A |
| 3,702,189 | 11/1972 | Galich | 273/73 J |
| 4,247,975 | 2/1981 | Robinson | 273/73 J |
| 4,591,156 | 5/1986 | Attenni | 273/73 J |

*Primary Examiner*—Edward M. Coven
*Assistant Examiner*—William E. Stoll
*Attorney, Agent, or Firm*—Beveridge, DeGrandi & Weilacher

[57] ABSTRACT

This invention concerns a racket handle characterized by the fact that it ends with an end-piece (3) and comprises a portion (5) which, in the use position, extends beyond the handle end, a portion (4) which surrounds the handle end, and a central hollow cylindrical portion (10) intended to receive an interchangeable balasting element (12).

1 Claim, 1 Drawing Sheet

RACKET HANDLE

BACKGROUND OF THE INVENTION

This invention relates to a racket handle comprising amongst others a core intended to be surrounded by a synthetic material layer, the latter being itself generally completed by wrapping of a leather strap or the like.

The object of the invention is to provide a racket handle the grip of which is notably improved while the shot properties of this racket can be modified according to the player's needs.

A particular object of the invention is precisely to provide a particular structure allowing an easy and quick interchangeability of the balasting elements.

In order to reach these objects, according to the invention the racket handle is ended with a piece which is an endpiece or adapter which is slided onto the end of the handle core and comprises a portion which, in the use position, extends beyond the handle end, a portion which surrounds the handle end, and a central cylindrial hollow portion which is slided into a cavity of a corresponding section provided along the axis of the handle core and intended to receive an interchangeable balasting element, while the end-piece portion which surrounds the core is intended to be embedded in said synthetic material.

Also according to the invention, said end-piece presents a peripheral projection located between the portion which in the use position extends beyond said handle and the portion which surrounds said end of the handle, which determines the distance along which the portion of said end-piece is embedded in the synthetical material.

SUMMARY OF THE INVENTION

According to the invention, a racket handle comprises a grip having a first end connected to the racket shaft, a second end with a plug fitted thereto, and a weight that is releasably fitted in an axially extending recess in the plug. The weight is positioned so that it does not protrude axially beyond the grip. The weight has a pair of radially protruding studs which are axially slidable in slots formed in the plug. A piece of springy elastic material is located at the bottom end of the bore, and the studs are positioned in a circumferentially extending groove which is in the bore at a position between the plug and the piece of springy elastic material.

Other details and advantages of the invention will become apparent from the following description of a racket handle according to the invention. This description is given by way of example and does not limit the invention scope. The reference numerals relate to the enclosed drawing.

DESCRIPTION OF THE PREFERRED EMBODIMENT

Figure 1:
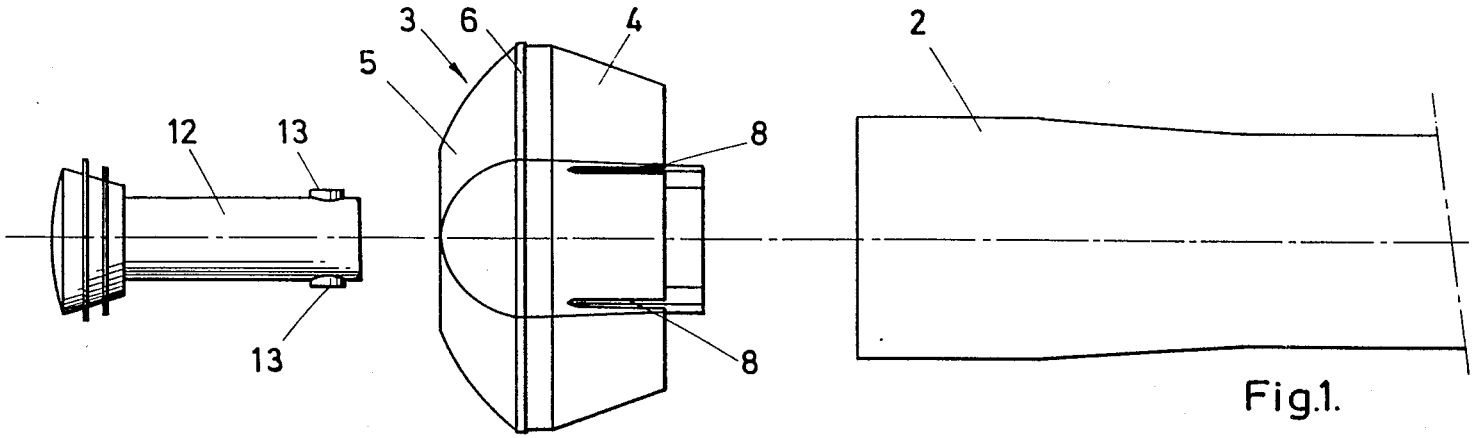
FIG. 1 is an exploded and elevation view showing the constituents of the end of the handle according to the invention.
Figure 2:
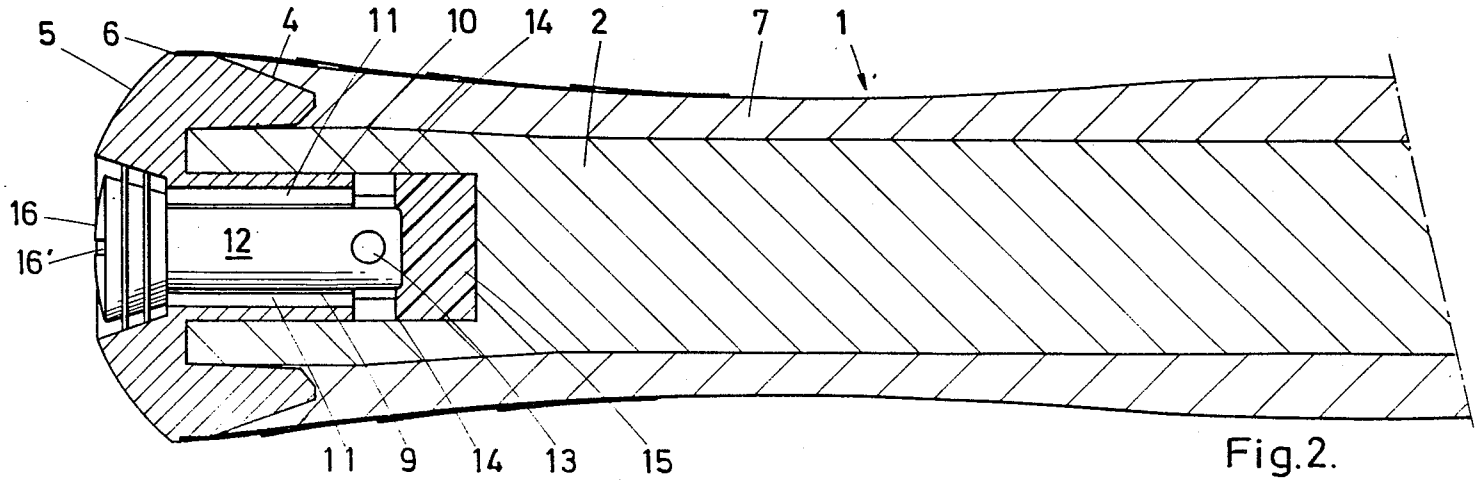
FIG. 2 is an elevation and cross-sectional view showing said elements when assembled.

The racket handle 1 according to the Figures comprises a core 2 onto the end of which is slided an end-piece 3 which comprises a portion 4 surrounding the end of the core 2 and a portion 5 which, in the use position, projects beyond the end of the handle. Both said portions 4 and 5 are separated by a peripheral projection 6 which determines the location up to which the end-piece is embedded in the synthetic material 7 which also surrounds the core 2 of the handle.

The portion 4 of the end-piece 3 extends slanting and outwardly in the direction of the peripheral projection 6. This peripheral projection 6 is located at the level of a section of higher diameter, which allows to obtain a handle presenting a particularly suitable grip.

The end-piece, which comprises a number of slits 8 along planes which coincide with the geometrical axis of the handle, is made of a flexible material such as flexible rubber or synthetic rubber or an elastomer. Centrally to the end-piece 3 an axial recess 9 is provided, this recess comprising a central cylindrical portion 10 which presents internal diametrallly opposed longitudinal slots 11 intended to receive an interchangeable balasting element 12, the latter being provided with two studs 13 cooperating with the longitudinal slots as a bayonet assembly. The central cylindrical portion 10 of the end-piece 3 enters to this end into the cavity 14 of corresponding section provided along the axis of the handle at the end of the latter.

At the bottom of the cavity 14, a piece 15 of springy elastic material, for example of rubber, is arranged, the element 12 being pushed back thanks to this piece through its studs against the free edge of the central cyclindrical portion 10.

Each interchangeable balasting element has a different weight and it is possible to modify the technical features of the racket thanks to the simplicity of the mounting system of these balasting elements.

The rotation of the interchangeable balasting element is obtained due to the presence of a slot 16' provided in the external portion of the head 16 of the balasting element.

It has to be understood that the invention is not limited to the described embodiment and that many modifications could be brought therein without departing from the scope of the present patent application.

What is claimed is:

1. A racket handle comprising a grip having a first end and a second end, said first end being connected to a shaft, a plug fitted to said second end of the grip, wherein the plug has an axially extending recess, and a weight means releasably fitted in said axially extending recess, said second end of the grip having an axially extending bore with a bottom end and an open end, said axially extending recess of said plug protruding into said bore, and said axially extending recess comprising first and second axially extending slots, a piece of springy elastic material arranged at said bottom end of said axially extending bore, and a circumferentially extending groove formed in said axially extending bore between said piece of springy elastic material and said plug, said weight means comprising a shaft with a head portion at its one end and first and second radially protruding studs at its other end, wherein said studs are adapted to slide in said axially extending slots and to enter into said circumferentially extending groove.

* * * * *